United States Patent [19]

Koll

[11] 4,173,104

[45] Nov. 6, 1979

[54] BOTTLE CAPPING APPARATUS AND METHOD

[75] Inventor: Stanley J. Koll, Keansburg, N.J.

[73] Assignee: American Flange & Manufacturing Co., Inc., Linden, N.J.

[21] Appl. No.: 897,197

[22] Filed: Apr. 17, 1978

[51] Int. Cl.[2] ..... B65B 7/28; B65B 59/04; B67B 3/14; B67B 3/12

[52] U.S. Cl. ..... 53/201; 53/351; 53/341; 53/368

[58] Field of Search ..... 53/3, 351, 488, 329, 53/341, 353, 368, 201, 344

[56] References Cited

U.S. PATENT DOCUMENTS

| | | | |
|---|---|---|---|
| 3,470,667 | 10/1969 | David et al. | 53/488 |
| 3,524,294 | 8/1970 | Koll | 53/488 |
| 3,660,963 | 5/1972 | Sullivan | 53/488 |
| 3,878,667 | 4/1975 | Holstein | 53/368 X |
| 4,099,361 | 7/1978 | Dix et al. | 53/201 X |

*Primary Examiner*—Horace M. Culver

[57] ABSTRACT

A method and apparatus for converting conventional bottle crowning machines for the proper application of lighweight metal tear off closures. The standard crowner mechanism is detached from the free end of a work imparting shaft mounted for vertical reciprocation along its longitudinal axis. A tear off closure applying head is installed in place of the crowner mechanism with a self-contained compensating spring unit interposed axially between the shaft end and the applying head. The converted machine is capable of uniformly applying tear off closures with adequate compensation for normal dimensional variations in the bottles being capped.

4 Claims, 8 Drawing Figures

BOTTLE CAPPING APPARATUS AND METHOD

BACKGROUND OF THE INVENTION

This invention pertains to a method and apparatus for converting conventional bottle crowning machinery for the application of lightweight metal tear off closures.

In U.S. Pat. No. 3,470,667 to C. David et al dated Oct. 7, 1969, there is disclosed a bottle crowning machine comprising a rotary crowner turret within which is reciprocally mounted a series of crowner plunger assemblies. This patent teaches the concept of interchangeably attaching either a conventional crown applying mechanism or a cap crimping head to the lower end of each plunger assembly whereby a conventional bottle crowning machine can be alternately employed for the application of crowns and lightweight metal tear off closures. My own U.S. Pat. No. 3,524,294, dated Aug. 18, 1970, discloses a somewhat different arrangement also for converting conventional crowning machinery for the interchangeable application of crowns and tear off closures. In that instance the conversion was accomplished by only partially disassembling the crowner mechanism, i.e., removing the crowner platform and throat subassembly and substituting a tear off closure crimping head in its place. This arrangement offered the advantage of utilizing the remaining crowner mechanism to actuate the crimping head and thus greatly simplified the conversion of certain machines.

The problem left unresolved by the two above mentioned patents concerns the ready conversion of certain crowning machines which for one reason or another do not supply the necesary mechanical action and safeguards for proper actuation of the tear off closure applying head. For example, a predetermined amount of vertical loading must be incorporated in the downward movement of the crowner plunger assembly to permit adaption of the crimping head in place of the conventional crowner mechanism. This vertical loading must become effective during the cap applying stroke in such a fashion as to compensate for normal bottle height variations and thus protect against damage to either the bottle or the crimping head. In those existing crowning machines which do not adequately provide for this type of compensation, the suitability for conversion to the application of tear off closures has, heretofore, remained questionable due to the rather extensive mechanical alterations required in the crowner plunger assembly.

SUMMARY

The method and apparatus of the invention herein disclosed effectively overcomes the above mentioned problem in providing a very simple arrangement for converting conventional crowning machinery to the crimping application of tear off closures while assuring the desired mechanical action for optimum capping efficiency. This is accomplished by the introduction of a compact, self-contained compensator spring unit during the conversion process so as to supply the necessary load compensating factor required for the crimping head. Such conversion is readily carried out by the simple interposition of this self-contained spring compensator unit between the crimping head and the lower end of the conventional crowner plunger assembly which has its crown applying mechanism removed. Thus it can be seen that this invention imparts an added degree of versatility to the interchangeable capping concept in facilitating the conversion of a wide variety of crowning machines to the application of lightweight metal tear off closures regardless of the loading characteristics built into the crowner plunger assembly.

It is accordingly a principle object of the invention to provide a new method and apparatus for interchangeably converting conventional crowning machines to the application of lightweight metal tear off caps.

Another object is to provide a novel method of capping bottles or other receptacles utilizing a predetermined vertically directed load factor.

Another object is to provide a new self-contained spring compensator unit for use in conjunction with cap applying machines so as to readily accommodate normal bottle dimension variations.

Still further and more detailed objects of the invention will in part be obvious and in part pointed out as the description of the invention taken in conjunction with the accompanying drawing proceeds.

DESCRIPTION OF THE PREFERRED EMBODIMENT

Figure 1:
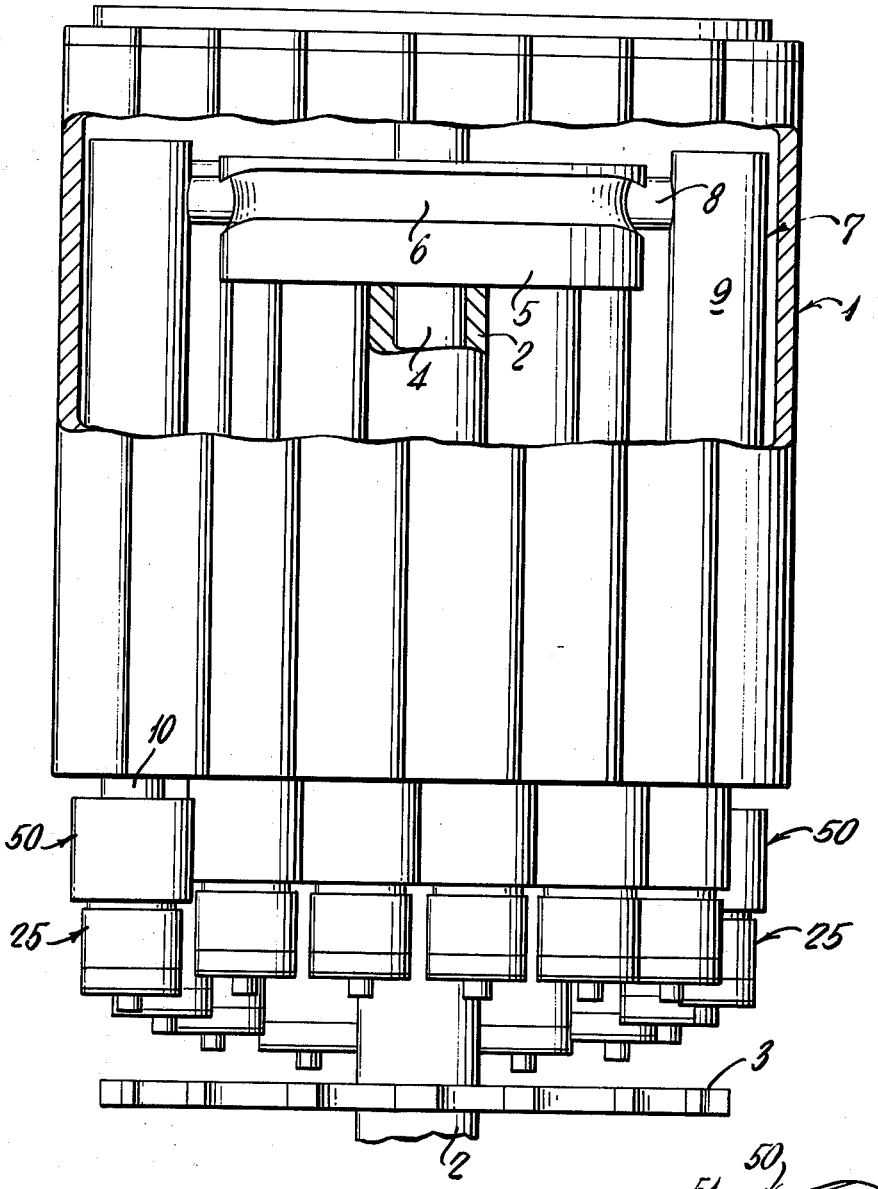
FIG. 1 is a vertical elevational view of a conventional crowner turret partially broken away for clarity and equipped with tear off cap applying heads and spring compensator units in accordance with the invention.
Figure 2:
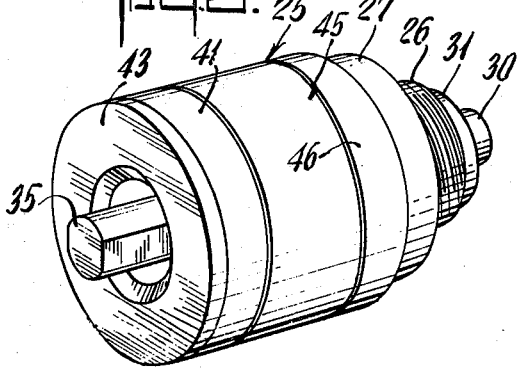
FIG. 2 is a perspective view of the tear off cap applying head.
Figure 3:
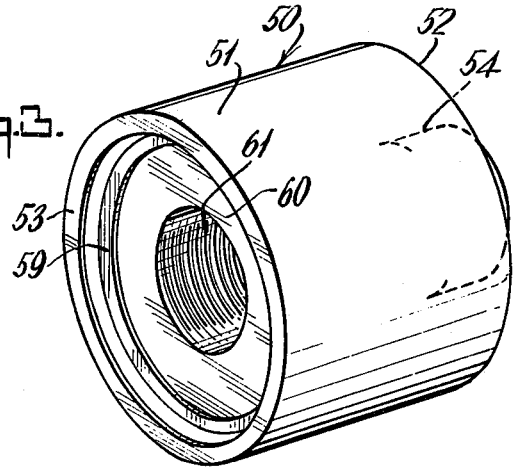
FIG. 3 is a perspective view of the spring compensator unit.

A crowner turret 1 forming part of a conventional crowning machine as shown in FIG. 1, is rotatably mounted on a central hollow drive shaft 2, directly above a bottle feed star wheel 3.

A fixed upright center shaft 4 extends axially through the hollow drive shaft 2. A drive wheel 5 carrying a peripheral cam race 6 is axially mounted on the upper end portion of the fixed shaft 4. A series of fifteen peripherally arranged crowner plunger assemblies 7 are mounted for vertical reciprocating movement within the crowner turret. A radially inwardly extending cam follower 8 is mounted near the upper end of each of the plunger assemblies 7 so as to ride within cam race 6.

Each plunger assembly 7 includes an outer cylinder sleeve 9 surrounding a work imparting shaft 10. Each shaft 10 has attached to its lowermost end a self-contained spring compensator unit 50 in accordance with the invention and a crimping head 25 for applying tear off bottle caps both to be fully described hereinafter.

The general operation of the above described bottle capping machine is as follows: bottles are fed in a circular path underneath each plunger assembly 7 by the star wheel 3 and, as the plunger assemblies rotate within the crowner turret 1 about the fixed center shaft 4, the cam followers 8 ride down the cam race 6. The plunger assemblies 7 are accordingly progressively lowered so that the crimping heads, secured to the lower end thereof, apply a lightweight metal tear off cap to each bottle as the turret and star wheel continue to rotate. Upon reaching the lowest point in the cam race 6, the cam follower 8 then moves upwardly again to its initial position releasing the crimping head from the bottle whereupon the capped bottle is conveyed by other suitable means (not shown) away from the star wheel 3.

Figure 4:
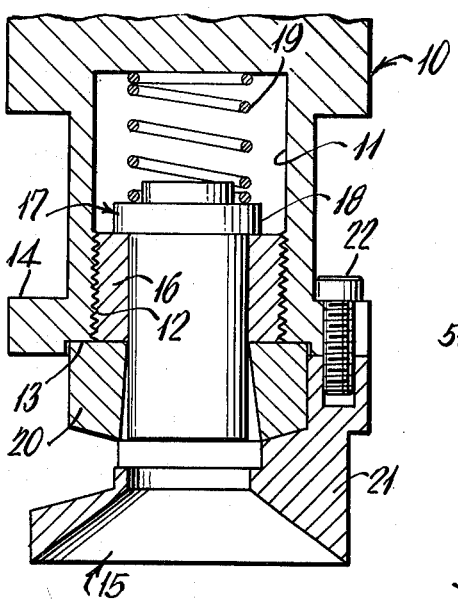
FIG. 4 is a vertical sectional view of a conventional crowner mechanism attached to a work imparting shaft.
Figure 8:
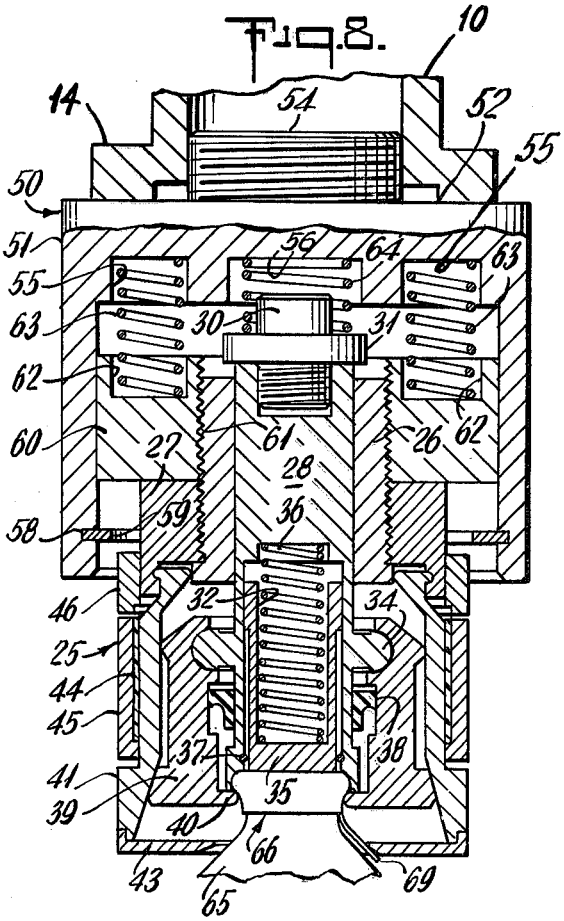
FIG. 8 is a vertical sectional view of the spring compensator unit and tear off cap applying head assembled to a work imparting shaft and showing a bottle in capping position.

As clearly seen in FIGS. 4 and 8 the work imparting shaft 10 is provided with an axially extending bore 11 having an internally threaded lower portion 12. The lowermost end of the bore terminates in an enlarged annular recess 13 surrounded by a circumferential flange 14.

Initially the bottle capping machine has each of its plunger assemblies 7 equipped with a crowner mechanism 15 for applying conventional steel fluted crowns as described in U.S. Pat. No. 3,524,294. In FIG. 4 the crowner mechanism 15 is shown as consisting of a bushing 16 threadedly engaged within the lower end portion of the shaft bore 11. An axially disposed crown engaging spindle 17 having a circumferentially enlarged retaining collar 18 adjacent its upper end is seated in the bushing 16 and urged downwardly by a coil compression spring 19. A crowner throat member 20 seats against the work imparting shaft recess 13 and is held in place by a crowner platform 21 attached to the shaft flange 14 by screws such as indicated at 22.

The application of conventional crown caps to filled bottles is carried out by the capping machine equipped with the above described crowner mechanisms. In order to compensate for the effect of normal variations in bottle height dimensions on the crowning operation, a down pressure override device (not shown) is incorporated in the plunger assembly 7. This device may just consist of a heavy duty compression spring or a simple travel lock-out arrangement to assure a predetermined vertical loading is achieved. At the instant the desired loading characteristic is reached, overriding movement of the work imparting shaft relative to the crowner mechanism occurs so as to prevent an excessive buildup of vertical force.

As is frequently the case, it becomes desirable to convert the above described capping machine for the application of lightweight metal tear off caps. To accomplish this, a substitution of the crimping head 25 for the crowner mechanism 15 is necessary. The crimping head 25, also described in U.S. Pat. Nos. 3,470,776 and 3,524,294, consists of an externally threaded cylindrical bushing 26 surrounded by an annular locking collar 27. Slideably received within the bushing 26 is a cap engaging spindle 28 having an internally threaded bore 29 at its upper end. A locking stud 30 is threadedly engaged within the bore 29 and provided with a circumferential flange 31 which overlies the upper end of the bushing 26 and thus limits downward movement of the spindle 28. The lower portion of the spindle 28 is provided with an axially extending bore 32 terminating at its lowermost end in a cap receiving nest 33. An annular support collar 34 surrounds the spindle 28 exteriorly of the bore 32.

A cylindrical cap hold-down member 35, closed at its lower end, is slideably received within the spindle bore 32. The member 35 is resiliently urged to a downwardly extended position by a lightweight coil compression spring 36 and locked within the bore by a pair of transverse roll pins 37. An annular spring 38, formed of resilient plastic material, surrounds the spindle 28 above the cap nest 33 for pivotally urging the jaws 39 to a radially open position.

A series of twelve annularly arranged sealing jaws 39 are pivotally supported on the support collar 34, each of the jaws having a radially inwardly facing crimping surface 40 at its lower end depending below the cap receiving nest 33. A segmented closing ring 41 made up of six segments which completely surround the jaws 39, is pivotally supported at 42 between the bushing 26 and the locking collar 27. A bottle guide plate 43 is mounted at the lowermost end of the jaws 39. The closing ring 41 is surrounded by a band 44 of yieldable plastic material housed within a rigid metal cylinder 45. A locking ring 46 disposed about the collar 27 retains the composite band and cylinder in place.

In converting some bottle capping machines from the application of fluted steel crowns to smooth skirted lightweight tear off caps, substitution of the above described crimping head 25 in place of the crowner mechanism 15 is not adequate. This is due to the fact that the down pressure override device incorporated in the plunger assembly, although suited to the crowning operation, does not supply the proper bottle loading characteristic when used in conjunction with the cap crimping head 25. Consequently, in order to assure effective compensation for increased load factors due to bottle height variations encountered during the tear off cap crimping operation, a complete separate, self-contained compensating spring unit is employed.

Figure 6:
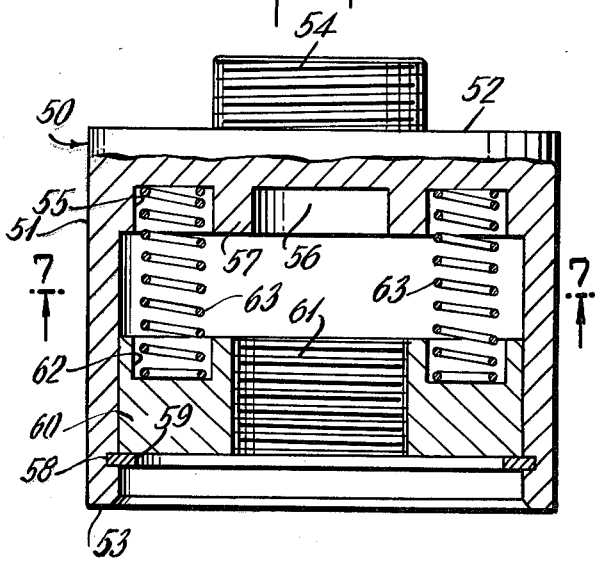
FIG. 6 is a vertical sectional view of the spring compensator unit.
Figure 7:
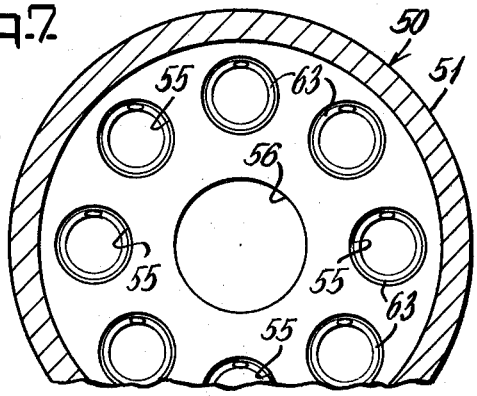
FIG. 7 is a sectional view taken along lines 7—7 in FIG. 6 and looking in the direction of the arrows.

As shown in FIGS. 6 and 7, this compensating spring unit, generally indicated at 50, consists of a cylindrical housing 51 having a closed end 52 and an open end 53. A threaded shank 54 protrudes axially away from the closed end 52. The interior of the housing endwall is formed with a plurality of downwardly opening recesses 55 arranged in a circular path about a central recess 56. An internal groove 58 is positioned adjacent the open end 54 of the housing 51 and has a snap ring 59 seated therewithin. A plunger member 60 is telescopically engaged within the housing interior and retained therewithin by the snap ring 59. The plunger member 60 is provided with a threaded center bore 61 and a plurality of upwardly opening annularly arranged recesses 62. A series of eight axially aligned coil compression springs 63 are annularly arranged within the housing 51 extending between the opposing recesses 55 and 62 so as to resiliently urge the plunger member 60 against the snap ring 59.

Figure 5:
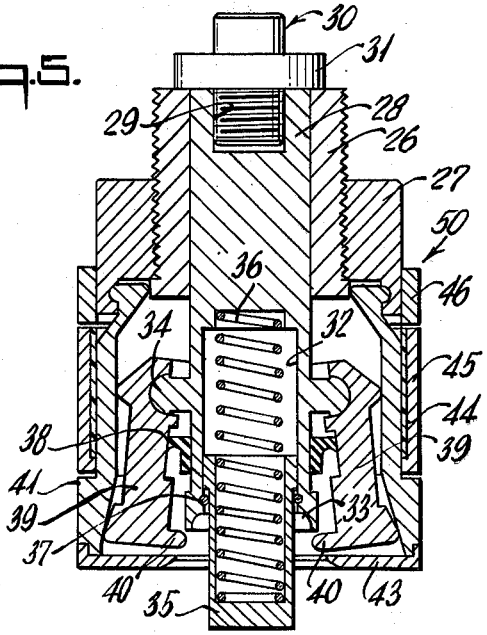
FIG. 5 is a vertical sectional view of the detached tear off cap applying head in a relaxed position.

In operation, when it is desired to convert the capping machine from the application of crowns to tear off caps, all that needs to be done, once the crowner mechanism 15 is detached, is to simply interpose the self-contained spring compensator unit 50 between the work imparting shaft 10 and the crimping head 25. Normally this is accomplished by threadedly engaging the housing shank 54 within the bore 12 of the work imparting shaft. The crimping head 25 can then be attached to the compensator spring unit by first placing a helical compression spring 64 over the locking stud 30 in the crimping head spindle 28 so that the spring lower end seats on the flange 31. The spring 64 is inserted in the bore 61 of the plunger 60 causing the spring upper end to seat within the housing recess 56. The crimping head 25 is then secured to the spring compensator unit 50 by threading the bushing 26 into the plunger bore 61. Final seating of the locking collar 27 against the plunger member 60 places the spring 64 under slight compression forcing the locking spindle 28 to its downwardly extended position with the jaws 39 fully open as shown in FIG. 5.

The cap applying operation is illustrated in FIG. 8 wherein the plunger assembly 7 carrying the shaft 10, is lowered with respect to a bottle 65 having a lightweight metal tear off cap 66 loosely seated thereon. The cap comprises a disc-like top 67 surrounded by a smooth depending skirt 68 having a tearing ear 69 extending downwardly and radially outwardly therefrom. The cap hold-down member 35 bears against the cap top 67 causing compression of the spring 36 whereupon the cap nest 33 presses the cap against the underlying bottle lip and the finger anvils 40 surround the cap skirt 68. Continued downward movement of the plunger assembly shaft 10 causes the segmented closing ring 41 to move downward relative to the now stationary center spindle 28. This in turn moves the cam surface on the closing ring downward relative to the fingers 39 and moves the fingers 39 radially inwardly causing the anvils 40 to smoothly crimp the cap skirt 68 in tight sealing engagement with the underlying bottle lip.

At this point in the cap applying operation it can readily be seen that even very slight dimensional variations in the bottle height will have a significant effect on the crimping action. For example, as the bottle height increases over a given nominal dimension, the greater the relative axial movement between the finger 39 and the closing ring 41. The resultant overworking of the finger anvils 40 against the bottle neck and its unavoidable detrimental effect must be counteracted. This is accomplished, as further seen in FIG. 8, by the normal functioning of the self-contained spring compensator unit 50. Once a predetermined vertical loading is applied to the bottle, the compression springs 63 start to yield and effectively prevent any further relative vertical displacement between the crimping fingers 39 and the closing ring 41. Consequently, any excess vertical force which would otherwise be applied directly to the bottle being capped is harmlessly compensated for by axial retraction of the plunger member 60 relative to the snap ring 59. Thus it can be seen that variations in travel distance between the work imparting shaft and the crimping head are effectively accommodated by the compensator spring unit. In the absence of compensation for this travel differential, the likelihood of damage is present. Upward movement of the work imparting shaft 10 at the termination of the capping stroke restores the various parts to their initial relaxed position.

Conversion back to the application of standard crowns is easily accomplished by simply disengaging the crimping head 25 and spring compensator unit 50 and returning the crowner mechanism 15 to fixed position at the end of the work imparting shaft 10. The crowning operation can then be carried out once again utilizing the compensating system originally incorporated in the plunger assembly.

Changes in and modifications of the method and apparatus of the invention as might suggest themselves to those skilled in the art could be made without departing from the spirit and scope of the invention. It is accordingly intended that all matter contained in the above description or shown in the accompanying drawing shall be interpreted as being illustrative and not in a limiting sense.

I claim:

1. In closure cap applying apparatus, a reciprocally mounted work imparting shaft, a self-contained compensator spring unit attached as a structurally independent mechanism to the lowermost working end of said shaft so as to depend therebelow said compensator spring unit including a cylindrical housing having one end closed and an open end, a plunger member telescopically fitted within said open end so as to be principally confined within said housing, compression spring means peripherally disposed within said housing for resiliently urging said plunger member axially away from said closed end, and a closure cap applying head axially connected to said compensator unit whereby variations in travel distance between said work imparting shaft and said closure cap applying head are accommodated by said self-contained compensator spring unit.

2. In closure applying apparatus as in claim 1 and spring means centrally disposed within said compensator spring unit for cooperative engagement with said closure cap applying head.

3. A self-contained compensator spring unit adapted for axial interposition as a structually independent mechanism between the working end of a reciprocating work imparting shaft and a closure cap applying head comprising a cylindrical housing having one end closed and an open end, securing means on said closed end, a plunger member telescopically fitted within said open end so as to be principally confined within said housing, securing means on said plunger member, compensating spring means peripherally disposed within said housing for resiliently urging said plunger member axially away from said closed end, and retaining means on said housing for holding said plunger member within said housing.

4. A self-contained compensator spring unit as in claim 3 and an axially disposed aperture communicating with the interior thereof.

* * * * *